United States Patent [19]

Perlman et al.

[11] 4,448,476

[45] May 15, 1984

[54] FUSE HOLDER

[75] Inventors: Stanley Perlman, Park Forest, Ill.; William G. Herbert, Goodland, Ind.; Donald Layton, Kentland, Ind.; James S. Hanafee, Rensselaer, Ind.

[73] Assignee: Permonite Mfg. Co., Morocco, Ind.

[21] Appl. No.: 377,062

[22] Filed: May 11, 1982

[51] Int. Cl.[3] ..... H01H 85/22; H01H 85/16; H01R 13/625

[52] U.S. Cl. ..... 339/203; 339/147 R; 337/213; 337/228

[58] Field of Search ..... 339/125 R, 126 R, 130 R, 339/147 R, 150 F, 201; 337/213, 227, 228, 229, 230, 237; 339/90 R, 147 P, 154 A, 203, 252 F, 253 F, 262 F

[56] References Cited

U.S. PATENT DOCUMENTS 3,891,291 6/1975 Blight et al. ..... 339/125 R X
4,072,385 2/1978 Wallner ..... 339/90 F X

FOREIGN PATENT DOCUMENTS 800059 8/1958 United Kingdom ..... 339/126 R
1159999 7/1969 United Kingdom ..... 339/147 R
1266160 3/1972 United Kingdom ..... 337/228

*Primary Examiner*—Eugene F. Desmond
*Assistant Examiner*—Steven C. Bishop
*Attorney, Agent, or Firm*—Wood, Dalton, Phillips, Mason & Rowe

[57] ABSTRACT

A fuseholder and method for manufacturing thereof, the fuse holder having a cap and a molded body to receive a fuse. The fuse holder has a first contact located at one end of the body to engage one end of the fuse. A cylindrical second contact having opposed J-shaped slots is disposed near the other end of the body. Engaging the other end of the fuse is a connector having a pair of tabs receivable by the J-shaped slots to form a conductive bayonet connection between the connector and the second contact. Protrusions on the connector slidably engage the second contact to maintain conductive contact therebetween if the bayonet connection is broken. The fuse holder can be adapted by modifying the connector or by using an adaptor to accommodate shorter fuses. To manufacture the fuse holder, the first and second contacts are insert-molded into the body.

10 Claims, 12 Drawing Figures

FIG. 6
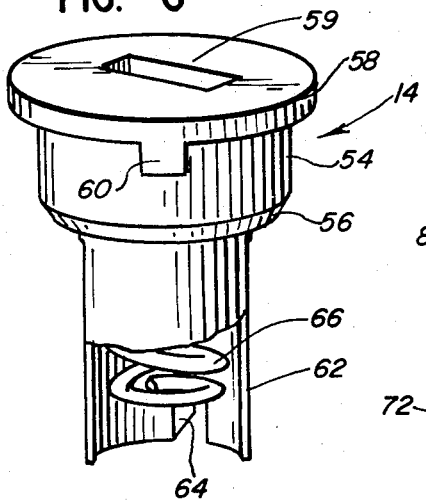
FIG. 9
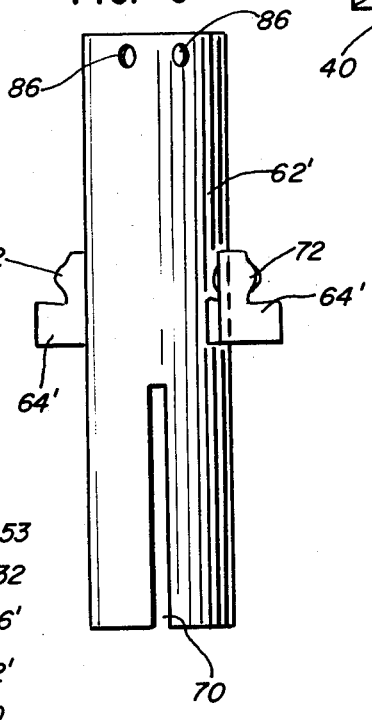
FIG. 5B
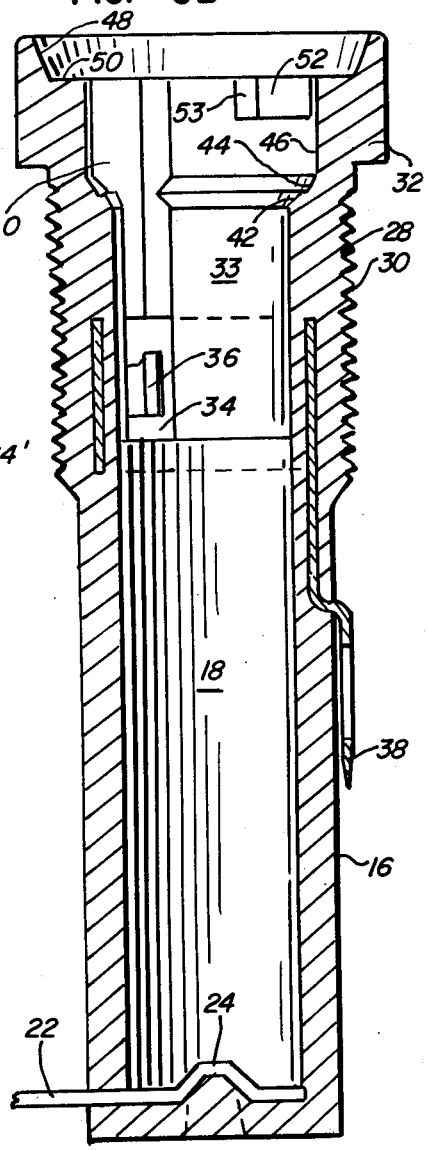
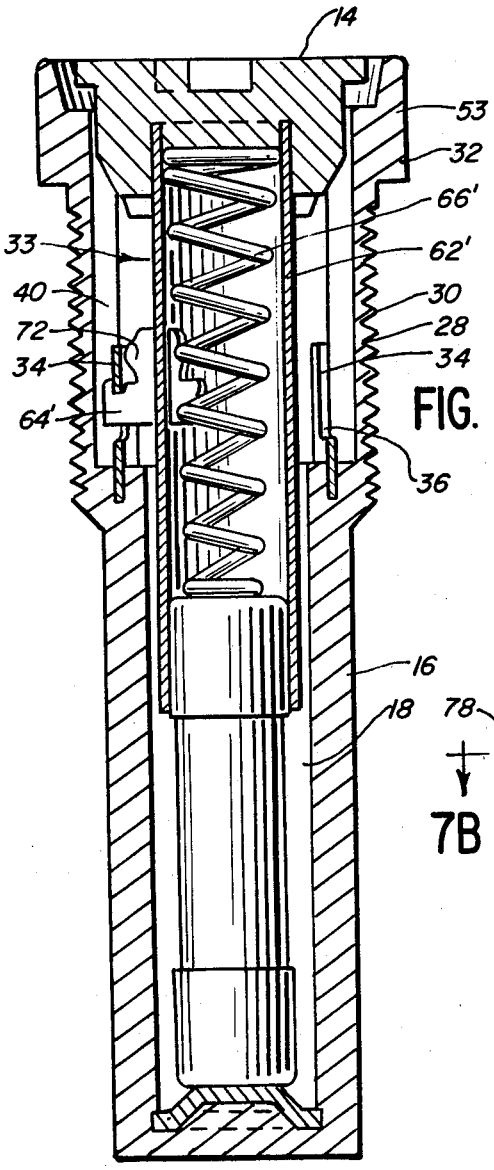
FIG. 8
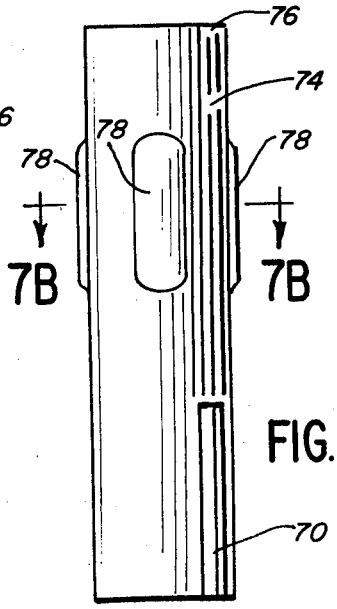
FIG. 7A
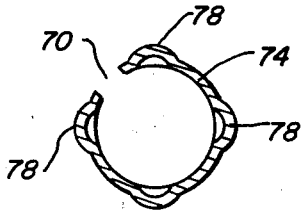
FIG. 7B

FUSE HOLDER

BACKGROUND OF THE INVENTION

1. Field of the Invention

This invention relates to fuse holders and methods for manufacturing thereof.

2. Description of the Prior Art

One type of fuse holder known in the prior art has a fuse receiving barrel of electrically insulating material such as plastic. At one end of the barrel is attached a first contact which conductively engages one end of the cylindrical fuse positioned in the barrel. A ferrule-like, conductive second contact, having opposing J-shaped slots therein, is disposed near the other end of the barrel. Both of the contacts eventually are connected to the circuit to be protected by the fuse. The fuse holder also includes a cap having a cylindrical, conductive connector receiving the other end of the fuse. The connector has a pair of outwardly extending tabs which are received in the slots of the second contact forming a bayonet connection between the connector sleeve and second contact. A spring disposed within the connector normally maintains the bayonet connection and thereby the conductive engagement between the fuse and the first contact and the connector and second contact. To protect the user of the fuse holder from receiving a shock from the second contact an insulating sleeve is interposed in the barrel, between the connector and the second contact, leaving only the bayonet connection to conductively interconnect the fuse to the second contact.

One notable drawback of the above described fuse holder is that the circuit through the fuse can be interrupted. Should force come in contact with the cap forcing the tabs out of engagement with the slots, conductive engagement therebetween is broken. Another drawback is that assembly of this type of fuse holder requires many steps and several parts including the insulating sleeve. This in turn increases the cost of manufacturing.

The Wallner U.S. Pat. No. 4,072,385 issued Feb. 7, 1978 describes a type of fuse holder having a second contact with an integral spring to maintain conductive contact between the component and the second contact should the cap be forced inward of the barrel. This type of fuse holder also requires the insulating sleeve and the multi-piece construction described above.

It is known in the prior art that cylindrical fuses, of the type having conductive ends, are manufactured in basically two sizes. One size, the American-type fuse, is 1.25 inches (31.75 mm) long and 0.25 inches (6.35 mm) in diameter. The other size, referred to as the European-type fuse, is 0.79 inches (20 mm) long and 0.20 inches (5 mm) in diameter. Accordingly, fuseholders should be adaptable to accommodate either the American-type fuse or the shorter European-type fuse.

SUMMARY OF THE INVENTION

Accordingly, a fuse holder not susceptible to inadvertent circuit interruption, and capable of being easily converted to accommodate either the American-type or European-type fuse is described. Additionally an improved method for manufacturing fuse holders is described.

The fuse holder of the present invention has a molded plastic body, a portion of which defines a barrel. At one end of the barrel is secured a conductive first contact which, when the fuse is received into the barrel, conductively engages one end of the fuse. A ferrule-like conductive second contact having J-shaped slots is disposed near the other end of the barrel. Attached to the cap of the fuse holder is a connector which receives the other end of the fuse. Tabs extend outward from the connector and, in cooperation with the slots in the second contact, form a conductive bayonet connection therebetween. A biasing means between the fuse and the connector maintains the bayonet connection, holding the fuse within the barrel and normally assuring electrical connection of the fuse ends to the first and second contacts. Should an inadvertent force move the cap so as to interrupt the connection between the connector tabs and the second contact, at least one outwardly extending protrusion on the connector slidingly and conductively abuts the second contact, assuring electrical connection therebetween.

To accommodate shorter fuses, an elongated connector having the characteristics set forth above may be used. Alternatively, an adapter may be interposed between the fuse and the connector.

To manufacture the above described fuse holder, at least the second contact and preferably both the first and second contacts are insert molded into the body of the fuse holder. During the insert molding process, a recess is formed in the body contiguous to each slot in the second contact to accommodate the reception of the tabs by the slots. It is seen that while the molded body envelopes the second contact to insulate the user therefrom, the second contact is left bare at a portion along its periphery, thereby permitting the tabs to engage the slots and the protrusion to conductively abut and slide along the second contact.

Accordingly, it is an object of the present invention to describe a fuse holder having a bayonet connection and including means to maintain electrical contact with the fuse in the event that the bayonet connection itself is broken.

It is a further object of the present invention to describe a method for manufacturing a fuse holder including insert molding of at least the second contact. Insert molding dispenses with involved assembly of the fuse holder.

It is yet a further object to set forth a fuse holder which is easily adaptable to accommodate the American-type fuses or the shorter, European-type fuses.

Further objects and advantages will become evident upon examination of the description, drawings and claims.

DESCRIPTION OF THE DRAWINGS

FIG. 5B is a longitudinal section view of the fuse holder body taken along line 5B—5B of FIG. 3 and illustrating a greater degree of draft of the fuse chamber than FIG. 1;

FIG. 6 is a perspective view of the fuse holder cap and connector with portions thereof removed for clarity;

FIG. 7A is a side view of an adapter to accommodate shorter European-type fuses;

FIG. 7B is a section view taken along line 7B—7B of FIG. 7A;

FIG. 8 is a section view of the fuse holder illustrating a further embodiment thereof adapted to accommodate the shorter European-type fuses;

FIG. 9 is a side view of the connection component of FIG. 8.

DESCRIPTION

Figure 1:
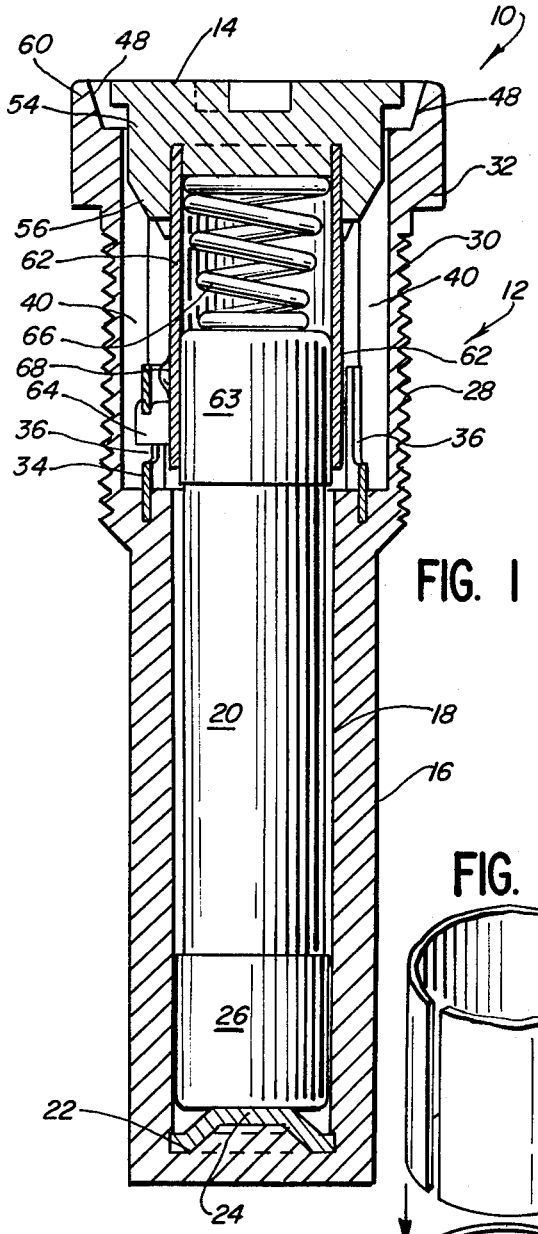
FIG. 1 is a longitudinal section view of the fuse holder illustrating the disposition of a fuse therein.
Figure 3:
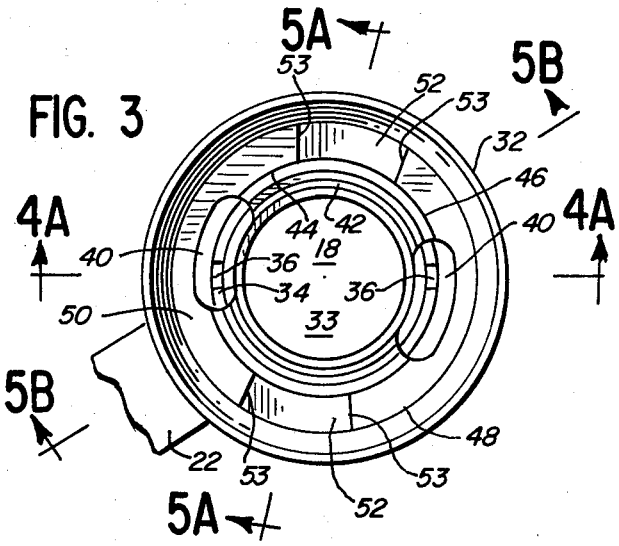
FIG. 3 is a top view of the fuse holder with the cap and the portion of the second contact lying within the fuse holder removed to illustrate the disposition of the second contact therein.
Figure 4A:
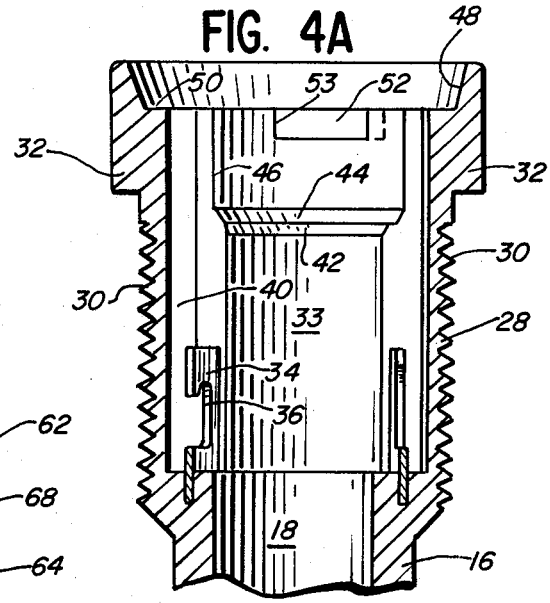
FIG. 4A is a section view of the top portion of the body of the fuse holder taken along line 4A—4A of FIG. 3.

Turning to FIGS. 1 through 6, an embodiment of a fuse holder 10 of the present invention is shown. The fuse holder 10 includes a body 12 and a cap 14, both molded from an electrically insulating material such as plastic. The body 12 has a cylindrical barrel 16, one end of which is closed and the inside of which defines a cylindrical chamber 18 of a size to receive a fuse 20. As shown in the drawings, the chamber 18 has somewhat of a draft from bottom to top to accommodate removal of the fuse holder body 12 subsequent to molding thereof. Disposed at the closed end of the chamber 18 and extending outward through the barrel 16 is a first contact 22. As seen in FIGS. 1, 4B and 5B, the first contact 22 has a boss 24 at the end within the chamber 18 to conductively contact a first end 26 of the fuse 20. The end of the first contact 22 outside the barrel 16 is adapted to be connected to a circuit.

Opposite the closed end, the diameter of the barrel 16 increases to form a cylindrical head 28. The head 28 has external threads 30 over which is threaded a nut (not shown) to secure the fuse holder 10 to a panelboard or the like. Opposing flats (not shown) interrupt the threads 30 to prevent the fuse holder 10, when secured in a mating opening in the panelboard, from rotating. At the end of the head 28 opposing the barrel 16 is a body flange 32. The body flange 32, in cooperation with the nut, sandwiches the panelboard therebetween to secure the fuse holder 10 to the panelboard. While the body flange 32 is shown as being relatively short, the body flange 32 can also be made somewhat larger. Accordingly, the fuse holder 10 when secured to the panelboard may be made to extend the desired length therefrom.

The chamber 18 of the barrel 16 continuous through the head 28 to have a terminus near the upper end thereof. As seen in the drawings, the chamber 18 cooperates with other structure (which will hereinafter be described) to define a cavity 33 within the head 28.

Figure 2:
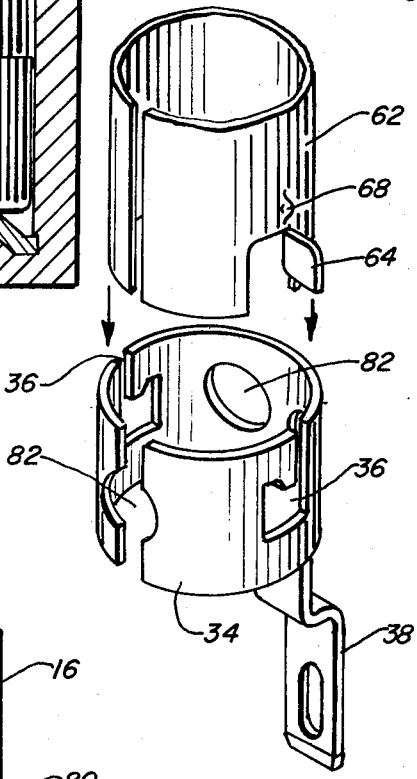
FIG. 2 is an exploded perspective view of the second contact and the connector of the fuse holder illustrating the connection therebetween.

Molded in the head 28, in a manner described in detail later, and extending around the chamber 18 is a conductive second conduct 34. As seen in FIG. 2, the second contact 34 is ferrule-like, is preferably constructed by rolling a flat strip of conductive material, and has a pair of diametrically opposing J-shaped slots 36. It is to be noted, however, that the second contact could just as well be constructed from a section of tubular material. The second contact 34 includes an arm 38 which, when the second contact 34 is secured in the head 28, extends outside the body 12 for connection to the circuit.

During the insert molding of the second contact 34 within the head 28, the plastic envelops the second contact 34 except in the vicinity of the slots 36. As seen in FIGS. 1, 3, 4A, 5A and 5B, a narrow recess 40 is formed contiguous to each slot 36 and extends almost the entire length of the head 28. These recesses 40 expose the second contact 34 in the vicinity of the slots 36 to the cavity 33. Since the recesses 40 are narrow, inadvertent contact of the second contact 34 by the fuss 20 during insertion or removal from the holder 10 or by the finger of an operator is prevented. This, in turn, protects the operator from receiving a shock from the circuit connected to the second contact 34. The foregoing insulation of the second contact 34, except for the portions necessary to form a bayonet connection described below, is accomplished without using a separate insulating sleeve as heretofore required by fuse holders in the prior art.

The remainder of the head cavity 33 includes progressively larger diameter, chamfered, first and second surfaces, 42 and 44 respectively, which coaxially form the transition from the chamber 18 to a cap bore 46 substantially disposed within the body flange 32. The cap bore 46 is of a diameter to receive the cap 14 and adjoins a larger diameter, tapered flange bore 48 thereby defining a peripheral ledge 50 which, as described below, limits the insertion of the cap 14 within the body 12 and, more particularly, the body flange 32. A pair of diametrically opposing, arcuate register notches 52, depend outward from the cap bore 46 to interrupt the ledges 50. The notches 52 serve to align the cap 14 as it is inserted into the body 12. Additionally, the notches 52 define radially directed walls 53 depending downward from the ledge 50 to limit rotation of the cap 14 relative to the body 12.

Turning to FIGS. 1, 2 and 6 the cap 14 of the holder 10 is shown. The cap 14, preferably molded from material similar to that of the body 12, has a cylindrical base 54 of a diameter to be received by the cap bore 46. One end of the base 54 has a peripheral chamfer 56 preventing the base 54 from abutting the wall of the cavity 33. At the other end of the base 54 is a larger diameter flange 58 adapted to be received into the flange bore 48 in the body 12. The thickness of the flange 58 is less than the axial length of the flange bore 48 thereby permitting the cap 14, when flush with the end of the body 12, a certain degree of axial movement into the cavity 33 before the flange 58 encounters the ledge 50. At the center of the flange 58 is a rectangular slot 59 to receive a tool, such as a screwdriver, for rotation of the cap 14.

Depending downward from the flange 58, as seen in FIG. 6, are a pair of diametrically opposed rectangular fingers 60. The fingers 60 are received by the notches 52 to align the insertion of the cap 14 within the cavity 33. As with the flange 58, the fingers 60 are relatively short to permit a degree of axial movement of the cap 14 into the cavity 33 before the fingers 60 engage the bottom of the notches 52. The fingers 60 are also more narrow than the notches 52 thereby permitting the cap 14 to partially rotate within the cavity 33, limited by the fingers 60 engaging the walls 53 of the notches 52.

A conductive, sleeve-like connector 62 extends coaxially downward, as viewed in the drawings, from the cap 14. The connector 62, formed by rolling a length of flat conductive material or by cutting a section of tubular material, has one end secured to the cap 14 by, for example, either insert molding or sonic welding. The other end of the connector 62 is of a size to closely receive a second end 63 of the fuse 20 and has, as best seen in FIG. 2, a pair of diametrically opposed, outwardly extending tabs 64. The tabs 64 are stamped and turned outward from the connector 62. It is to be noted that the tabs 64 and the fingers 60 are arranged such that when the fingers 60 are aligned with the notches 52 in the flange bore 48, and more particularly contiguous to one wall 53 thereof, the tabs 64 are aligned with the J-shaped slots 36 of the second contact 34.

Secured within the connector 62 as by, for example, an interference fit, is a coil spring 66. The spring 66 is disposed so as to permit partial initial insertion of the fuse second end 63 within the connector 62 without exerting sufficient bias to force the fuse 20 therefrom. However, additional insertion of the fuse other end 63 into the component 62 results in a bias between the cap 14 and the fuse 20.

The insertion and connection of the fuse 20 within the holder 10 can now be described. The second end 63 of the fuse 20 is partially inserted into the connector 62 to hold the fuse 20 to the cap 14. Inserting the cap 14 and fuse 20 into the body 12 loads the fuse 20 into the chamber 18. As stated above, due to the enveloping of the second contact 34 by the insulating plastic inadvertent contact between the fuse 20 and the second contact 34 is prevented during loading of the fuse 20. Aligning the cap fingers 60 with the notches 52 aligns the tabs 64 with the slots 36. As the fuse 20 is inserted, the fuse first end 26 abuts the first contact 22 and the tabs 64, accommodated by the recesses 40, align with the slots 36. Pushing the cap 14 downward against the bias of the spring 66 until the fingers 60 engage the bottom of the notches 52, rotating and releasing the cap 14 forms a conductive bayonet connection between the connector 62 and the second contact 34. Accordingly, the tabs 64 are conductively held within the slots 36 of the second contact 34 by the bias of the spring 66 thereby completing the circuit through the fuse 20.

It is to be noted that should it be desirable to secure the cap 14 to the body 12 without including the fuse 20 as, for example, during shipment, the engagement between the tabs 64 and slots 34 may be used in the manner described above. However, since the fuse 20 is not present the spring 66 cannot bias the cap 14 outward upon release of the tabs 64 from the slots 36. Accordingly the chamfered flange bore 48 provides sufficient space between the flange 58 of the cap 14 to enable the insertion of a tool to urge the cap 14 from the body 12.

Should the cap 14 holding the fuse 20 be inadvertently depressed into the body 12, the tabs 64 would disengage the second contact 35 breaking the bayonet connection therebetween. To prevent the circuit from being interrupted by such an occurrence, at least one and preferably a pair of protrusions are interposed between the connector 62 and the second contact 34. While the drawings show a pair of protrusions 68 extending outwardly from the connector 62 it is to be understood that an alternative structure would be to provide protrusions on the second contact 34. The protrusions 68 which may take the form of nipples, are stamped in the connector 62 just above the tabs 64 as seen in FIGS. 1 and 2. These protrusions 68 are of a size to abut and slide along the second contact 34. Therefore, even should the cap 14 be depressed, the protrusions 68 slide along the second contact 34 in the vicinity of the slots 36 maintaining the circuit through the fuse 20, its first end 63, the connector 62 and the second contact 34. Accordingly, intricate designs such as spring members disposed in J-shaped slots 36 employed by some prior art fuse holders are not required to maintain the circuit through the fuse 20.

Turning to FIGS. 7A through 9, further embodiments of the holder 10 are shown which have been adapted to receive shorter, European-type fuses. Similar parts have the same reference numerals. Parts which have been modified will be indicated by a prime (').

To accommodate the shorter fuses, the cap 14 may be provided with a conductive connector 62' shown in FIGS. 8 and 9. The connector 62' is elongated, having one end secured to the cap 14, the other end having a longitudinal slit 70 to permit the connector 62' to spread as the fuse 20 is inserted therein. Medially depending outward from the connector 62' are diametrically opposed tabs 64' having generally an L-shape. Each tab 64' has on its portion paralleling the connector 62', a projection 72 adapted to slidably engage the second contact 34 to maintain the circuit in the manner described above. Again it is to be understood that the projection could alternatively be located on the second contact 34. An elongate spring 66' is interposed between the fuse and the cap 14 to provide the bias necessary for the bayonet connection.

In the alternative, the fuse holder 10 shown in FIG. 1 and described above, is provided with an adapter 74 to accommodate shorter fuses. The adapter 74, shown in FIGS. 7A and 7B, is an elongate, hollow, conductive cylinder having a slit 70 to enable the adapter 74 to spread and closely receive the fuse. Medially stamped from the adapter 74 are a plurality of outwardly directed protuberances 78 adapted to slidably and conductively engage the inside of the connector 62.

To accommodate shorter fuses, one end of the fuse is inserted into the slit end of the adapter 74. The spring 66 is replaced by elongate spring 66' and the adapter 74 and fuse are inserted within the connector 62. Spring 66' normally maintains the bayonet connection between the connector 62 and the second contact 34 in the manner described above. Accordingly, the circuit through the fuse is maintained through the adapted 74, its protuberances 78, the connector 62 and the second contact 34. Should the cap 14 be depressed into the body 12, the protuberances 78 and protrusions 68 prevent the interruption of the circuit.

To manufacture the fuse holder 10 described above, at least the second contact 34 and preferably both the first and second contact 22 and 34 are insert molded into the body 12 during the molding thereof. Insert molding dispenses with the requirement for separate insulating sleeve and the separate assembly heretofore required for fuse holders.

A suitable method for insert molding of the contacts includes injecting fluid plastic into a mold (not shown) about a plug (also not shown) coaxially protruding into the mold. The inside surface of the mold defines and forms the outer surface of the body 12 while plug forms the chamber 18, cavity 33, cap bore 46 and the other internal structure of the body 12 set forth above. It is to be noted that the plug may be such that the walls of the chamber 18 are somewhat conical so as to form a draft to permit easy removal of the plug from the fuse holder body 12. FIG. 5B illustrates the draft of the chamber 18.

Figure 4B:
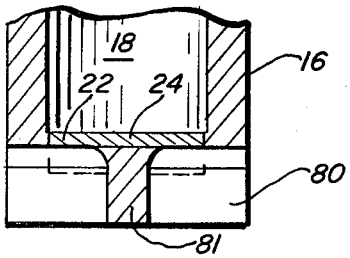
FIG. 4B is a section view of the lower portion of the fuse holder body rotated with respect to the fuse holder shown in FIG. 4A.
Figure 5A:
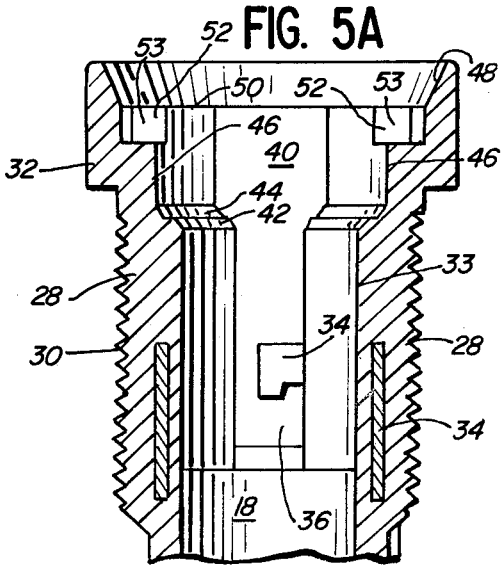
FIG. 5A is a section view of the top portion of the fuse holder body taken along line 5A—5A of FIG. 3.

Prior to injecting the plastic into the mold, the first contact 22 is disposed at the bottom of the mold and is sandwiched against the end of the plug by a bifurcated ridge running across the bottom of the mold. From the foregoing it follows that when the plastic is injected into the mold and allowed to solidify, the first contact 22 becomes secured therein with its boss 24 being exposed to the cavity 18. The ridge at the bottom of the mold holding the first contact 22 during the insert molding forms the U-shaped gap 80 and a bridge 81 at the closed end of the barrel 16 as shown in FIGS. 4B and 5B. The bridge 81 provides additional support to hold the first contact 22 within the barrel 16.

To insert mold the second contact 34 within the head 28 of the fuse holder body 12, the second contact 34 is appropriately held in the mold by a bifurcated retainer. The retainer may be part of the plug or may be separately provided. The diametrically opposed sections of the second contact 34 containing the slot 36 are inserted into the bifurcated retainer, the retainer closely abutting the plug and having an outer surface to form the recesses 40. To assure that the second contact 34 becomes securely positioned within the head 28, the second contact 34 is provided with openings 82 to insure that the fluid plastic properly envelopes all portions of the second contact 34 not protected by the retainer. The arm 38 passes through the mold and thereby is likewise protected from being enveloped by the plastic.

Accordingly, during the molding of the body 12, the fluid plastic envelopes the second contact 34 except for the portions thereof having the J-shaped slots 36 which are protected by the retainer. The retainer also forms the recesses 40 to accommodate the tabs 64, enabling the bayonet connection between the connector 62 and the second contact 34. When the plastic solidifies and the body 12 is removed from the mold it is seen particularly at FIG. 5B that the second contact 34 is insulatingly enveloped by the plastic except in the vicinity of the slots 36 which remain exposed due to the retainer. The exposed area of the second contact 34 is relatively narrow, thereby preventing inadvertent contact with the second contact 34 which could result in shock to the user of the holder 10. Furthermore, the arm 38 is left bare external of the barrel 16 for electrical connection thereto.

In a like manner the connector 62 or 62' may be insert molded to the cap 14. Bores 86, shown in FIG. 9, accommodate the complete flow of plastic about the end of the connector during insert molding.

It is seen that the above described insert molding of the first and second contacts 22 and 34 results in a fuse holder which can be manufactured in essentially one step. Separate insulating sleeves are not required for the second contact 34 in that the plastic forming the body 12 insulatingly envelopes all but the portions thereof necessary to maintain contact with the fuse 20.

While we have shown and described certain embodiments of a fuse holder, and a method for manufacture thereof, it is to be understood that it is subject to modification without departing from the invention described herein and set forth in the claims.

we claim:

1. A fuse holder for receiving cylindrical fuses of the type having conductive ends, said fuse holder comprising:

a body to receive the fuse;

a first contact disposed in said body to conductively engage one end of said fuse;

a second contact disposed in said body, said second contact having at least one J-shaped slot;

a cap having a connector to conductively engage the other end of said fuse, said connector having a tab received in each slot and conductively engaged between the fuse and the second contact with the connector and second contact in a first position;

a conductive protrusion interposed between said connector and said second contact to maintain sliding contact between the connector and the second contact in the event said connector and second contact are moved relative to each other and away from said first position without relative rotation so that the tab disengages said second contact; and a biasing means between said connector and said second contact to maintain the tabs in said slots and against said second contact, forming a bayonet connection therebetween.

2. The fuse holder described in claim 1 wherein said protrusion is located on and extends inwardly from said second contact to abut said connector and maintain sliding conductive contact therewith.

3. The fuse holder described in claim 1 wherein said protrusion is located on and extends outwardly from said connector to slidingly abut said second contact and maintain conductive contact therewith.

4. The fuse holder described in claim 3 wherein said protrusion is disposed above each tab.

5. the fuse holder described in claim 4 wherein said protrusion is nipple-shaped.

6. A fuse holder for receiving cylindrical fuses of the type having conductive ends, said fuse holder comprising:

a body to receive the fuse;

a first contact disposed in said body to conductively engage one end of said fuse;

a second contact disposed in said body, said second contact having at least one J-shaped slot;

a cap having a connector to conductively engage the other end of said fuse, said connector having a tab to engage and be retained by each slot for conductive engagement between said fuse and said second contact through the connector tab and slot;

a conductive protrusion interposed between said connector and said second contact to maintain sliding contact between the connector and the second contact in the event said tab is depressed within said slot;

a biasing means between said connector and said second contact to maintain the tabs in said slots forming a bayonet connection therebetween; and an elongate, cylindrical, conductive adapter having one end adapted to receive the other end of a short fuse and having at least one outwardly directed protuberance to conductively engage and slide along said connector thereby maintaining electrical connection between said second contact and the other end of said short fuse.

7. The fuse holder described in claim 6 wherein said connector is cylindrical and the adapter is received within said connector.

8. The fuse holder described in claim 7 wherein said biasing means is a spring housed within the connector to engage the said other end of said fuse to maintain said bayonet connection.

9. A fuse holder for a short, European-type cylindrical fuse having conductive ends, said fuse holder comprising:

a body to receive the fuse;

a first contact disposed at one end of said body to conductively contact one end of said fuse;

a second contact disposed near the other end of said body, said second contact having at least one J-shaped slot;

a conductive connector insertable into said body and having at one end a cap, the other end adapted to receive the other end of said fuse, said connector having an intermediate outwardly directed L-shaped tab for reception by each slot to form a conductive bayonet connection therebetween, and said tab having an outwardly protruding projection to slidingly abut said second contact maintaining conductive contact therebetween; and biasing means between said connector and said second contact to maintain said bayonet connection.

10. The fuse holder described in claim 9 wherein said second contact is ferrule-like having a pair of diametrically opposed J-shaped slots and said connector has a pair of L-shaped tabs received by said slots forming the bayonet connection therebetween.

* * * * *